US006161774A

United States Patent [19]

Ricco

[11] Patent Number: 6,161,774

[45] Date of Patent: Dec. 19, 2000

[54] ELECTROMAGNETIC FUEL INJECTOR FOR INTERNAL COMBUSTION ENGINES

[75] Inventor: Mario Ricco, Bari, Italy

[73] Assignee: Elasis Sistema Ricerca Fiat Nel Mezzogiorno Societa Consortile per Azioni, Pomigliano d'Arco, Italy

[21] Appl. No.: 09/163,578

[22] Filed: Sep. 30, 1998

[30] Foreign Application Priority Data

Oct. 2, 1997 [IT] Italy ..... TO97A0874

[51] Int. Cl.[7] ..... F02M 47/02

[52] U.S. Cl. ..... 239/127; 239/533.8; 239/585.1; 239/600

[58] Field of Search ..... 239/533.8, 585.1, 239/533.9, 124, 127, 600

[56] References Cited

U.S. PATENT DOCUMENTS

| | | | |
|---|---|---|---|
| 2,244,394 | 6/1941 | Hautzenroeder . | |
| 2,391,808 | 12/1945 | Vincent | 239/533.8 |
| 2,536,542 | 1/1951 | Evans et al. | 239/533.8 |
| 3,997,117 | 12/1976 | Kohler | 239/533.8 |
| 4,129,255 | 12/1978 | Badar, Jr. et al. | 239/96 |
| 4,156,560 | 5/1979 | Cheklich | 239/533.8 |
| 4,516,730 | 5/1985 | Fussner | 239/533.8 |
| 4,709,679 | 12/1987 | Djordjevic et al. | 123/447 |
| 5,429,154 | 7/1995 | Kato | 239/533.8 X |
| 5,542,610 | 8/1996 | Augustin | 239/533.8 |
| 5,655,716 | 8/1997 | Mathis | 239/533.8 |

FOREIGN PATENT DOCUMENTS

| | | | |
|---|---|---|---|
| 304745 | 3/1989 | European Pat. Off. | 239/533.8 |
| 2146576 | 3/1973 | France . | |
| 675199 | 7/1979 | U.S.S.R. | 239/533.8 |
| 521736 | 5/1940 | United Kingdom | 239/533.8 |

*Primary Examiner*—Kevin Weldon
*Attorney, Agent, or Firm*—Ladas & Parry

[57] ABSTRACT

The injector has a hollow body having an injection nozzle controlled by a control rod movable axially by a metering valve controlled by an armature of an electromagnet. The metering valve has a control chamber having a pressurized-fuel inlet conduit and a surplus fuel drain conduit. To reduce the length of the injector, the inlet conduit is coaxial with the rod and communicates with a coaxial cavity fed with fuel from the top; the drain conduit is radial with respect to the axis of the rod, and the armature is also movable radially; the armature and the electromagnet are housed in an arm which is also radial with respect to the axis of the rod; and the cavity has a conical portion in which a bulb-shaped portion of a fitting of a supply conduit is fitted by means of a ring nut.

6 Claims, 2 Drawing Sheets

ELECTROMAGNETIC FUEL INJECTOR FOR INTERNAL COMBUSTION ENGINES

BACKGROUND OF THE INVENTION

The present invention relates to an electromagnetic fuel injector for internal combustion engines.

Various types of electromagnetic fuel injectors are known, in one of which, a hollow body carries an injection nozzle, which is opened and closed by a rod movable axially inside the hollow body. The rod in turn is controlled by a metering valve controlled by an axially-moving armature and comprising a control chamber having a radial inlet conduit and an axial drain conduit. Injectors of this type are invariably bulky in length and therefore call for a cylinder head of suitable height.

In modern engines, the injector are normally connected to a common supply conduit (rail) fed by a pump with high-pressure fuel. In the case of known injectors of the above type, the common conduit must be located laterally with respect to the injector body, and is therefore difficult to house and connect.

SUMMARY OF THE INVENTION

It is an object of the present invention to provide a highly straightforward, reliable fuel injector designed to eliminate the aforementioned drawbacks typically associated with known injectors.

According to the present invention, there is provided an electromagnetic fuel injector for internal combustion engines, comprising a hollow body having an injection chamber communicating with a pressurized-fuel supply conduit; an injection nozzle carried by said hollow body and communicating with said injection chamber; a control rod movable axially in said hollow body to open and close said nozzle; end a metering valve having a control chamber, in turn, having an inlet conduit communicating with said supply conduit, and a drain conduit communicating with a drain chamber for surplus fuel; a shutter of the metering valve is controlled by an armature of an electromagnet to open and close said drain conduit; characterized in that said inlet conduit is parallel to the axis of said rod, and said drain conduit is radial with respect to the axis of said rod.

BRIEF DESCRIPTION OF THE DRAWINGS

A preferred, non-limiting embodiment of the present invention will be described by way of example with reference to the accompanying drawings, in which.

DETAILED DESCRIPTION OF THE INVENTION

Figures 1, 6:
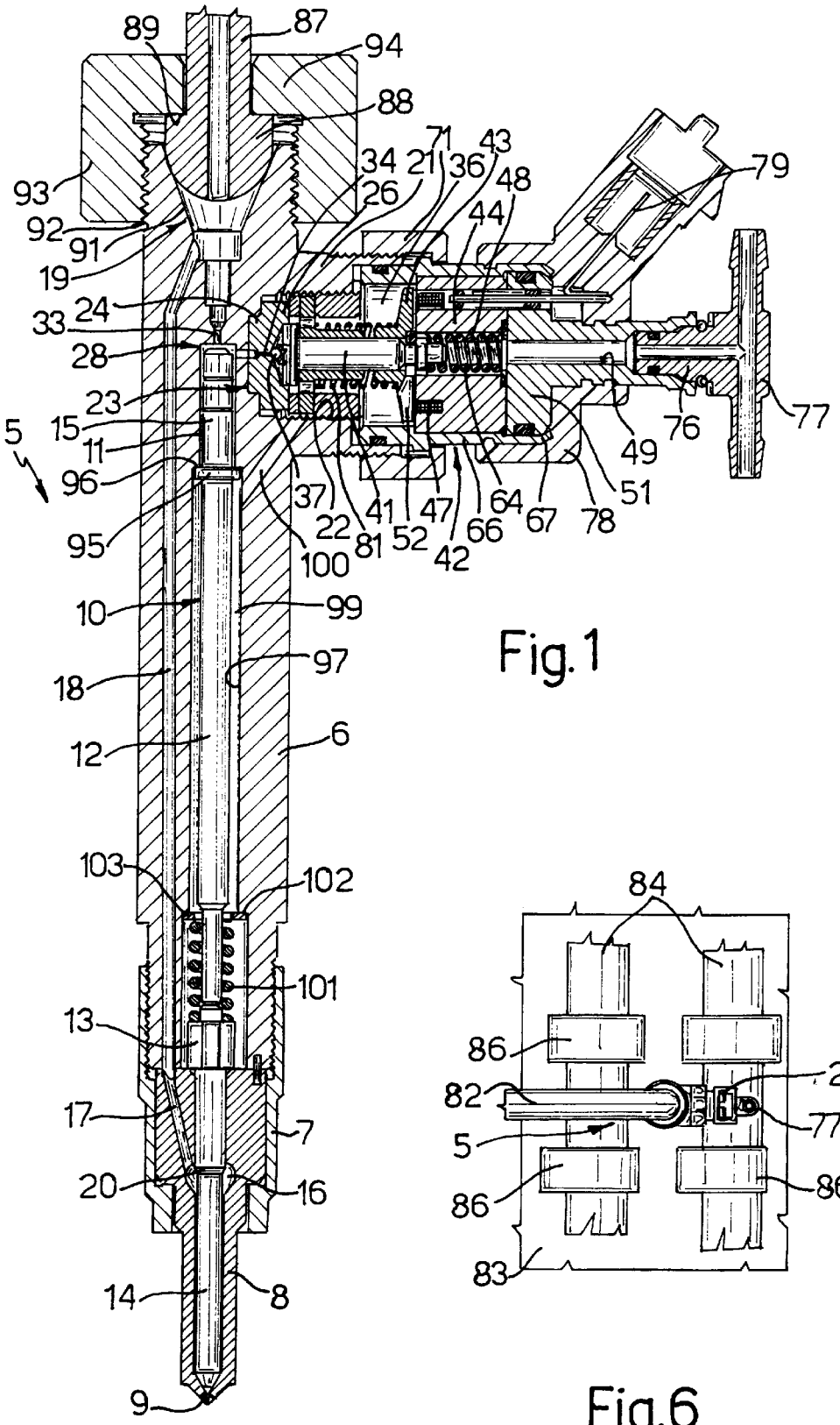
FIG. 1 shows a half-section of a fuel injector in accordance with the present invention.
FIG. 6 is a top plan view showing the injector as housed on an internal combustion engine.

Numeral 5 in FIG. 1 indicates as a whole a fuel injector for an internal combustion engine. Injector 5 comprises a substantially cylindrical hollow body 6 fitted, by means of a threaded ring nut 7, with a nozzle 8 terminating with one or more injection orifices 9. Hollow body 6 has a cylindrical cavity 10 comprising a small-diameter top portion 11 forming a seat for axially guiding an end portion 15 of an axially-movable control rod 12, which acts on a member 13 of a pin 14 for closing orifice 9.

Nozzle 8 comprises an injection chamber 16 communicating, via a conduit 17 in nozzle 8 and a conduit 18 in hollow body 6, with a pressurized-fuel supply cavity indicated as a whole by 19 and described in detail later on. At injection chamber 16, pin 14 comprises a shoulder 20.

According to the invention, hollow body 6 comprises a lateral arm 21 having a cylindrical cavity 22, the axis of which is radial with respect to that of cavity 10 and therefore with respect to the axis of rod 12. Cavity 22 houses a metering valve indicated as a whole by 23, and which comprises a body 24 having a flange 26 (FIG. 2) normally held resting against a shoulder 27 of cavity 22, as described in detail later on.

Valve 23 also comprises a control chamber 28, which in turn comprises an axial hole 29 of body 24, and an end portion 31 of portion 11 of cavity 10, defined by an end surface 32 of rod 12. Control chamber 28 also comprises a calibrated inlet conduit 33, which communicates with portion 31, is parallel to the axis of rod 12, and also communicates with supply cavity 19 of injector 5.

Control chamber 28 also comprises a calibrated drain conduit 34, which is coaxial with hole 29 and therefore radial with respect to the axis of rod 12; drain conduit 34 communicates with a drain chamber 36 defined by an annular portion of cavity 22; drain conduit 34 of control chamber 28 is normally closed by a shutter in the form of a ball 37, which rests on a conical seat 38 communicating with conduit 34; and ball 37 is guided by a guide plate 39 acted on by an intermediate element defined by a flange 40 of a cylindrical stem 41.

Metering valve 23 is activated by an electromagnet 42 (FIG. 1), which controls an armature 43 connected to stem 41 as described in detail later on. Electromagnet 42 comprises a cylindrical core 44 made of magnetic material and having an annular cavity 46 housing the electric coil 47 of electromagnet 42; core 44 has a central hole 48 (FIG. 1) coaxial with a hole 49 in a drain fitting 51; and armature 43 is substantially disk-shaped with at least one opening 52 through which drain chamber 36 communicates with central hole 48 of core 44.

A flange 54, integral with a bush 56 in which stem 41 slides, normally rests against flange 26 (FIG. 2) of body 24 of metering valve 23 via the interposition of a washer 53 of calibrated thickness; flange 26 is held resting against shoulder 27 of hollow body 6 by a ring nut 57 engaging flange 54; ring nut 57 is threaded externally and screwed to a thread in cavity 22; and flange 54 comprises axial holes 58 connecting conical seat 38 to drain chamber 36.

Armature 43 is integral with a sleeve 59 slidable axially along stem 41, which has a C-shaped ring 61 cooperating with a shoulder 62 of armature 43. Stem 41 extends a given length inside hole 48 of core 44, and terminates with a small-diameter portion 63, which provides for supporting and anchoring a first compression spring 64 housed inside hole 48.

Core 44 and drain fitting 51 (FIG. 1) are housed in a cylindrical jacket 66 having an edge 67, which is crimped, i.e. pinched cold, to keep fitting 51 integral with core 44, and to keep core 44 against a shoulder 66 (FIG. 2) of jacket 66.

Jacket 66 is connected, via the interposition of a seal 69, to arm 21 of hollow body 6 by a further threaded ring nut 71, which is screwed onto an external thread of arm 21 so that a bottom edge 72 of jacket 66 rests against a shoulder 73 of arm 21, via the interposition of a further washer 74 of calibrated thickness and which defines the desired travel of armature 43.

Drain fitting 51 (FIG. 1) may be so formed as to permit connection of one arm 76 of a T-fitting 77 by which to connect injector 5 to a conduit for feeding fuel from drain chamber 36 back into the fuel tank (not shown); and a base 78, made of insulating material and supporting the pin 79 of coil 47, is molded in known manner onto jacket 66.

Another compression spring 81 is provided between armature 43 and flange 54 (FIG. 2) of bush 56 to keep armature 43 normally resting against C-shaped ring 61; and flange 40 of stem 41 is arrested against flange 54, so that the thickness of washer 53 defines the gap between armature 43 and core 44, i.e. the stop position of armature 43 when attracted by core 44.

Pressurized fuel is fed by a high-pressure pump from the tank to the various injectors 5 on the engine along a common supply conduit or so-called rail 82 (FIG. 6) located on the cylinder head 83 of the engine, and which the injector 5, in the case of an engine with four valves per cylinder, may be located between the two shafts 84 of the valve cams 86. The seat of each injector 5 on cylinder head 83 may advantageously be located between the four valve cams 86 of the corresponding cylinder.

For each injector 5, conduit 82 comprises a downward-facing fitting 87 (FIG. 1), which is connected to the corresponding supply cavity 19 of injector 5. More specifically, each fitting 87 terminates with an ogival or bulb-shaped end 88 having an annular shoulder 89; and cavity 19 comprises a truncated-cone-shaped top portion 91 coaxial with inlet conduit 33 of chamber 28.

Portion 91 is engaged by respective bulb-shaped end 88, so that the injector is top-fed; and body 6 comprises an external thread 92 engaged by a threaded ring nut 93 having a bent edge 94, which engages shoulder 89 of fitting 87 to force bulb-shaped end 88 against the surface of truncated-cone-shaped portion 91 and so permit fast, effective connection of injector 5 to common conduit 82.

The upward travel of rod 12 must be arrested precisely, so that end surface 32 does not engage the end surface of portion 11 of cavity 10, and the lateral surface of portion 15 does not close hole 29 communicating with drain conduit 34; and rod 12 advantageously comprises a ring 95, which is arrested against a shoulder 96 of cavity 10, which defines the diameter of an intermediate portion 97 of cavity 10.

Figure 3:
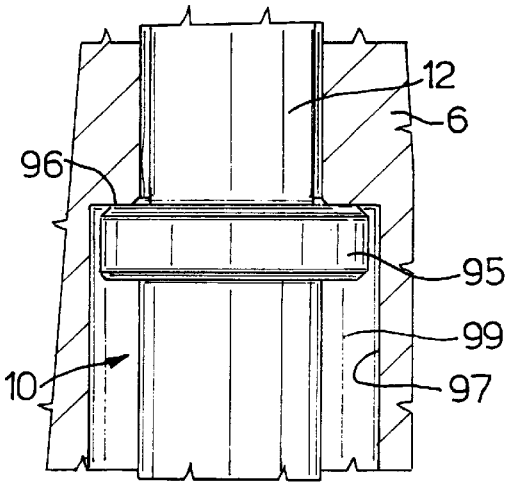
FIG. 3 shows a larger-scale detail of FIG. 1.

In the FIGS. 1 and 3 embodiment, ring 95 is integral with rod 12. In the FIG. 4 modified embodiment, ring 95 is integral with a bush 98, which is welded, e.g. laser welded, to rod 12.

Figure 4:
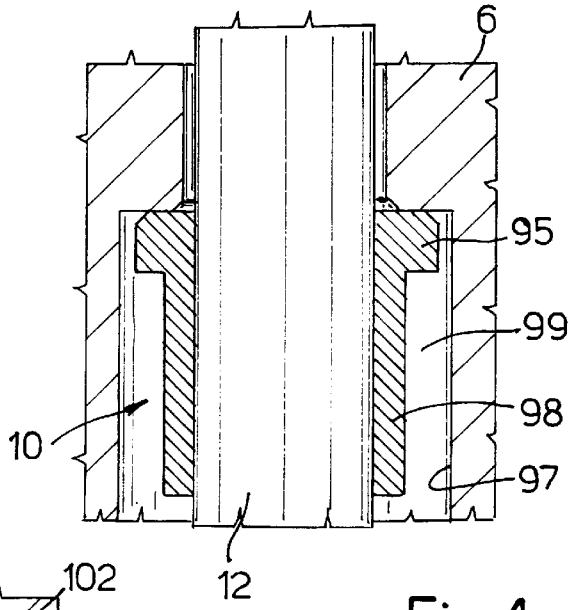
FIG. 4 shows the FIG. 3 detail according to a modified embodiment of the invention.

In both the FIGS. 3 and 4 embodiments, a gap 99 inevitably exists between rod 12 and portion 97 of cavity 10, and in which fuel may flow from control chamber 28 (FIG. 1). To drain this fuel into the tank, gap 99 is connected to drain chamber 36 by a connecting conduit 100.

Figure 5:
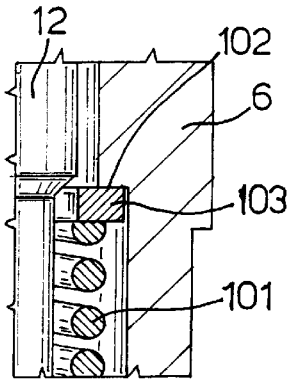
FIG. 5 shows a further larger-scale detail of FIG. 1.

To ensure rapid closure of orifice 9 of nozzle 8 by pin 14 when electromagnet 42 is deenergized, a compression spring 101 is provided between hollow body 6 and member 13 of pin 14, and is precompressed between member 13 and a shoulder 102 of cavity 10. To minimize the diameter of hollow body 6, shoulder 102 (FIG. 5) is extremely small, but large enough to support a washer 103 having an inside diameter smaller than that of portion 97, and which provides for effectively supporting spring 101.

Injector 5 operates as follows.

By virtue of the larger area of end surface 32 of rod 12 as compared with that of shoulder 20, and with the aid of spring 101, the pressure of the fuel inside control chamber 28 (FIGS. 1 and 2) and injection chamber 16 normally keeps rod 12 in the lowered position with pin 14 closing orifice 9 of nozzle 8. When coil 47 is energized, core 44 attracts armature 43, which, by means of shoulder 62 and C-shaped ring 61, pulls stem 41 in opposition to spring 64, so that flange 40 of stem 41 is arrested against fixed flange 54, and armature 43 is arrested with shoulder 62 against ring 61.

The pressure of the fuel in chamber 28 therefore opens shutter 37 to drain the fuel from chamber 28 back into the tank through holes 58, drain chamber 36, opening 52 in armature 43, hole 48 in core 44, and hole 49 in fitting 51. In turn, the pressure of the fuel in chamber 16, by acting on shoulder 20, overcomes the residual pressure on end surface 32 of rod 12 and the action of spring 101, so that pin 14 is raised to inject the fuel in chamber 16 through orifice 9 into the corresponding cylinder on the engine. The upward travel of rod 12 is arrested upon ring 95 contacting shoulder 96 of hollow body 6.

Figure 2:
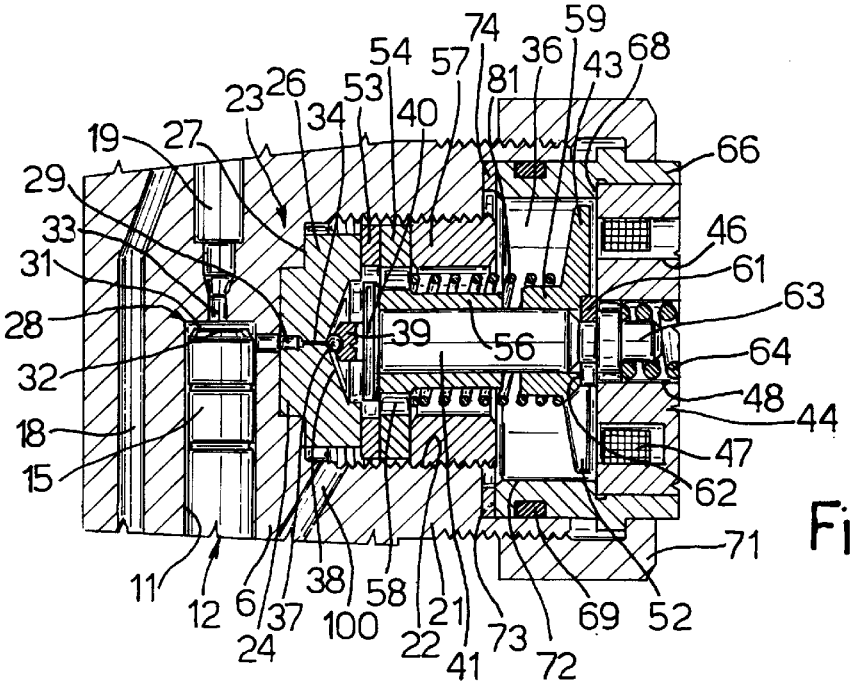
FIG. 2 shows a larger-scale view of part of the FIG. 1 injector.

When coil 47 is deenergized, spring 64 pushes stem 41 leftwards in FIG. 2 together with armature 43 by means of ring 61; flange 40 of stem 41 pushes shutter 37 against seat 38 to close drain conduit 34; and the incoming pressurized fuel along conduit 33 restores the pressure inside control chamber 28 to lower rod 12, together with pin 14, and so close orifice 9.

As compared with known injectors, the advantages of injector 5 according to the invention will be clear from the foregoing description. In particular, injector 5 is easier to seat on cylinder head 83, and therefore easier to install on engines with four valves per cylinder. Moreover, the injector is connectable rapidly to common supply conduit 82. And finally, injector 5 provides for reducing the thickness of cylinder head 83 and therefore the overall height of the engine.

Clearly, changes may be made to the injector as described and illustrated herein without, however, departing from the scope of the accompanying Claims. For example, a ring may be provided between sleeve 59 (FIG. 2) of armature 43 and bush 56 to reduce vibration caused by displacement of armature 43 with respect to stem 41. Jacket 66 of electromagnet 42 may be integral with arm 21 of hollow body 6. And finally, fitting 87 of supply conduit 82 and supply cavity 19 of hollow body 6 may be formed differently, and may be connected using seals.

What is claimed is:

1. An electromagnetic injector for internal combustion engines, comprising a hollow body having a first cylindrical cavity provided with a first axis; an injection nozzle carried by said hollow body at one end of said first cavity, said nozzle having an injection chamber communicating with a pressurized fuel supply conduit and with at least one injection orifice; a control rod movable axially in said first cavity to open and close said at least one orifice; a lateral arm integral with said hollow body, said lateral arm having a second cylindrical cavity provided with a second axis radial with respect to said first axis; a metering valve housed in said second cavity and including a drain conduit radial with respect to said first axis and communicating with a drain chamber for surplus fuel; said metering valve further including a shutter; an electromagnet having an armature connected to control said shutter to open and close said drain conduit; said electromagnet having a cylindrical core coaxial with said second cavity, said armature being movable in said second cavity along said second axis; and a control chamber for hydraulically controlling said rod, said control chamber having an inlet conduit parallel to said first axis and communicating with said supply conduit so that when said shutter is released by said armature the pressurized fuel in said control chamber is drained through said drain conduit and the pressurized fuel in said injection chamber moves said rod to open said at least one orifice, said drain chamber (36) communicating with a drain fitting (51) extending radially with respect to the axis of said rod (12), said inlet conduit (33) and said injection chamber (16) communicating with a supply cavity (19) coaxial with said inlet conduit (33) and connectable to a further fitting (87) fitted to said supply conduit (82).

2. An injector as claimed in claim 1, wherein said supply cavity (19) is provided with a conical end portion (91), and said further fitting (87) comprises a bulb-shaped portion (88) engaging said conical portion (91); a threaded ring nut (93) being provided to force said bulb-shaped portion (88) against said conical portion (91).

3. An injector as claimed in claim 1, wherein said rod (12) has an end surface (32) defining said control chamber (28), and a portion (15) which is guided by a seat (11) located at one end of said cylindrical cavity (10); said rod (12) having a ring (95) which is arrested against a shoulder (96) of said cylindrical cavity (10).

4. An injector as claimed in claim 3, wherein said rod (12) is normally maintained in a closed position closing said nozzle (8) by the pressure of the fuel in said control chamber (28) acting on said end surface (32) and with the aid of a compression spring (101); characterized in that said compression spring (101) is located between a member (13) of said first pin (14) and a washer (103) engaging a second shoulder (102) of said cylindrical cavity (10).

5. An injector as claimed in claim 3, characterized in that said ring (95) is integral with said rod (12).

6. An injector as claimed in claim 3, characterized in that said ring (95) is carried by a bush (98) welded to said rod (12).

* * * * *